US006196556B1

(12) United States Patent
Bonaventure et al.

(10) Patent No.: US 6,196,556 B1
(45) Date of Patent: Mar. 6, 2001

(54) ROLLER SKATE

(75) Inventors: Laurent Bonaventure, Cran-Gevrier; Jean-Louis Demarchi, Saint-Jorioz, both of (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 08/759,416

(22) Filed: Dec. 5, 1996

(30) Foreign Application Priority Data

Dec. 8, 1995 (FR) ..... 95 15016

(51) Int. Cl.[7] ..... A63C 17/06

(52) U.S. Cl. ..... 280/11.202; 36/3 B; 36/115; 280/11.231

(58) Field of Search ..... 36/3 R, 3 A, 3 B, 36/113, 114, 115; 280/11.19, 11.22, 11.27, 811, 11.202, 11.231

(56) References Cited

U.S. PATENT DOCUMENTS

| | | | | |
|---|---|---|---|---|
| 2,751,692 | | 6/1956 | Cortina | 36/3 |
| 3,012,342 | * | 12/1961 | Ramirez | 36/3 B |
| 3,624,930 | * | 12/1971 | Johnson et al. | 36/3 B X |
| 4,507,880 | * | 4/1985 | Ohashi | 36/3 B X |
| 4,602,441 | | 7/1986 | El Sakkaf | 36/3 R |
| 4,679,335 | | 7/1987 | Berlese | 36/131 |
| 4,860,463 | | 8/1989 | Pin | 36/3 B |
| 4,939,851 | * | 7/1990 | Miller | 36/3 B |
| 5,171,033 | | 12/1992 | Olson et al. | 280/11.22 |
| 5,342,070 | | 8/1994 | Miller et al. | 280/11.22 |
| 5,365,677 | | 11/1994 | Dalhgren | 36/3 A |
| 5,390,941 | * | 2/1995 | Pozzobon et al. | 280/11.22 X |
| 5,400,526 | | 3/1995 | Sessa | 36/3 B |
| 5,401,039 | | 3/1995 | Wolf | 280/11.22 |
| 5,437,466 | | 8/1995 | Meibock et al. | 280/11.22 |
| 5,515,622 | | 5/1996 | Lee | 36/3 R |
| 5,797,610 | | 8/1998 | Grande et al. | 280/11.22 |

FOREIGN PATENT DOCUMENTS

| | | | |
|---|---|---|---|
| 177905 | 4/1905 | (DE) . | |
| 9406345 | 7/1994 | (DE) | A43B/13/20 |
| 2019194 | 10/1979 | (GB) . | |
| 53447 | 5/1967 | (PL) . | |
| WO86/03951 | 7/1986 | (WO) | A43B/7/06 |
| WO95/13716 | 5/1995 | (WO) | A43B/7/06 |
| WO95/29605 | 11/1995 | (WO) . | |
| WO98/35572 | 8/1998 | (WO) . | |

* cited by examiner

*Primary Examiner*—Michael Mar
(74) *Attorney, Agent, or Firm*—Greenblum & Bernstein, P.L.C.

(57) ABSTRACT

In-line roller skate including a chassis of which one longitudinal lower portion carries the wheels, on the one hand, and a boot formed by a shell overlaying a sole adapted to be fixed on an upper plate of the chassis, on the other hand, the volume of the upper being in communication with the outside so as to obtain the internal ventilation thereof by air supply, wherein it includes air passages interposed between an external collecting zone and the internal volume of the shell, these air passages being constituted by a ventilation chamber provided beneath an internal plantar support of the boot and communicating with the internal volume of the shell.

33 Claims, 3 Drawing Sheets

FIG. 1
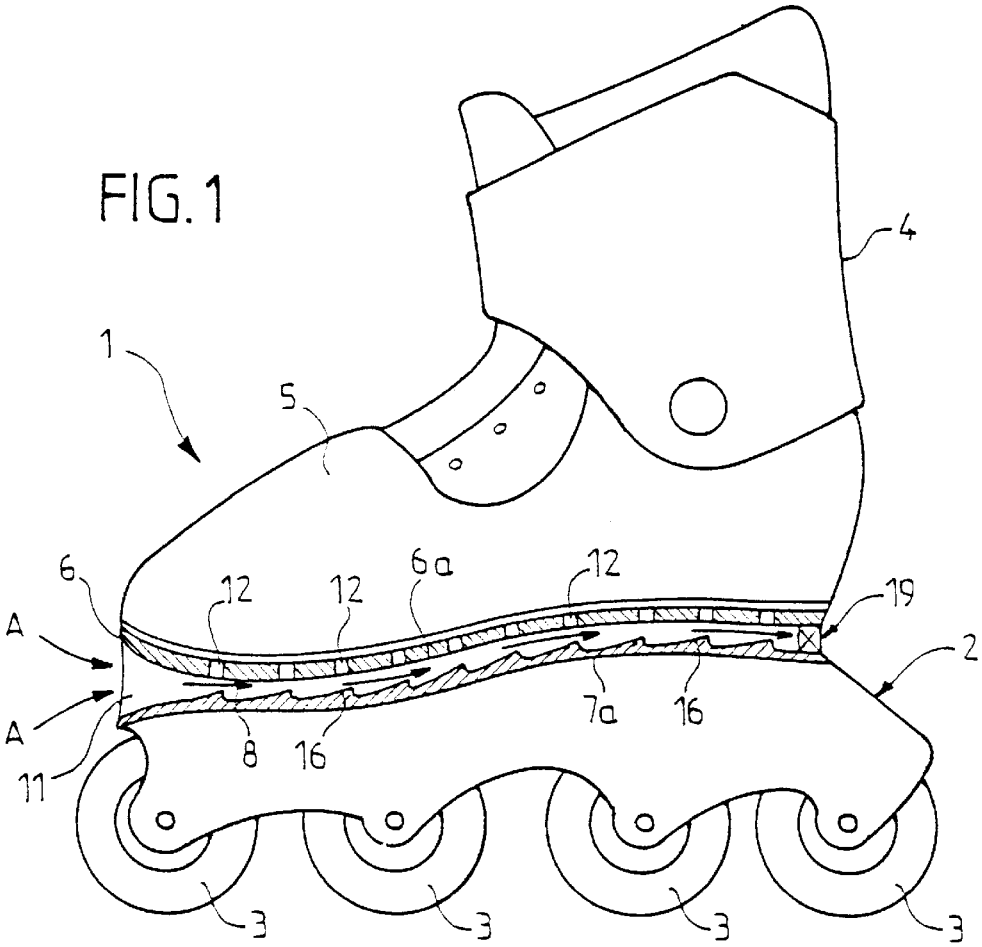
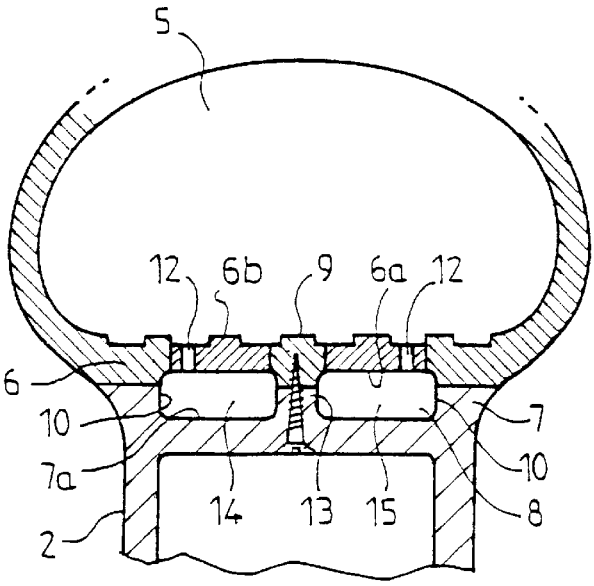
FIG. 2
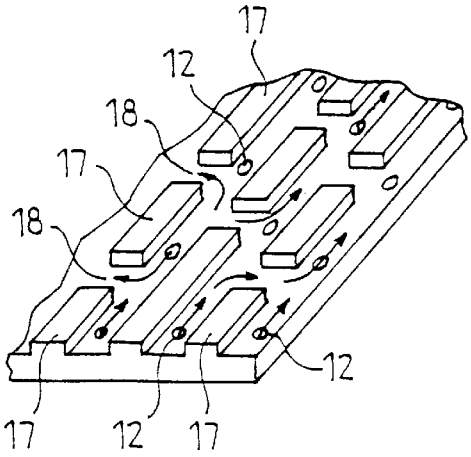
FIG. 3

ROLLER SKATE

BACKGROUND OF THE INVENTION

1. Field of the Invention

The present invention relates to a roller skate, and especially an in-line roller skate, including a chassis of which one longitudinal lower portion carries the wheels, on the one hand, and a boot formed by an upper overlaying a sole adapted to be fixed on an upper plate of the chassis, on the other hand, the internal volume of the upper and/or sole being in communication with the outside, so as to obtain the internal ventilation thereof by air supply.

2. Background and Material Information

The aforementioned type of skate is adapted to the training of ice skaters outside of a skating rink, but also for any athletes eager to maintain or perfect, on a tarred hard ground, cemented floor, etc., the techniques used in gliding sports such as trail skiing, cross-country skiing, ice skating, etc.

Thus, the practice of this sport includes a driving or propelling phase that occurs by causing the skate to diverge outwardly and by taking a lateral support on the wheels that are thus inclined, in a manner similar to edge setting, then a gliding phase that occurs by repositioning the wheels perpendicularly with respect to the ground.

A boot of this type is known from U.S. Pat. No. 5,171,033. This patent describes a boot that has the particularity of being made from a rigid shell including a plurality of ventilation openings leading in the internal volume of the shell. A liner is freely arranged in this shell so that the movements of the foot cause an internal ventilation by means of a cooperation between the pumping action provided by the movement of the liner within the shell and the openings of the shell.

If such a concept is capable of promoting the aeration of the foot, it however maintains all of the rigidity of the boot, because although the shell receives a flexible liner, it constitutes a firm foot-enveloping structure.

Furthermore, the effectiveness of the pumping action exerted by the liner is quite uncertain due to the fact that in a boot of this type, one precisely seeks to avoid any relative foot movement that generates discomfort (friction, blisters) and lack of precision One also seeks in such a product a flexible and light boot structure which ensures a good foot retention, a comfort of use, and less fatigue.

U.S. Pat. No. 5,401,039 teaches ventilating the internal volume of the shell by supplying in the air captured outside by holes provided on the lower plane of the sole, via a conduit at the end of which an air inlet is provided, and inside which a turbine affixed to one of the wheels of the skate is positioned to ensure the rotational drive thereof.

This is complicated design due to the fact that it requires the use of moving elements. In addition, the air is freely introduced in the shell, which provides a diffuse aeration that does take into account that a moving foot has specific sweating points toward which the ventilation air must preferably be directed.

SUMMARY OF THE INVENTION

An object of the present invention is to remedy the aforementioned drawbacks and to achieve the desired results mentioned hereinabove. Therefore, an object of the present invention is to provide an improved in-line roller skate that especially allows for a good foot ventilation and conciliates foot retention, comfort and lightness.

To this end, the invention relates to an in-line roller skate including a chassis of which one longitudinal lower portion carries the wheels, on the one hand, and a boot formed by an upper overlaying a sole adapted to be fixed on an upper plate of the chassis, on the other hand, the volume of the upper and/or sole being in communication with the outside so as to obtain the internal ventilation thereof by air supply, wherein it includes air passage arrangement interposed between an external air collection zone and the internal volume of the shell, these air passages having a non-deformable volume.

Advantageously, these air passages are constituted by a ventilation chamber having a non-deformable volume provided beneath a plantar support of the boot and communicating with the internal volume of the upper.

BRIEF DESCRIPTION OF DRAWINGS

The present invention is also related to the characteristics which will become apparent from the following description, and which must be considered separately or according to their possible technical combinations.

This description provided by way of a non-limiting example, will help to better understand how the invention can be embodied, with reference to the annexed drawing, in which:

FIG. 1 is a side elevation view of an in-line roller skate and of an associated boot ventilated according to the invention;

FIG. 2 is a transverse cross-sectional view of the skate according to FIG. 1;

FIG. 3 is an internal detailed view showing the plantar support of the sole;

DETAILED DESCRIPTION OF THE PREFERRED EMBODIMENTS

Figure 4:
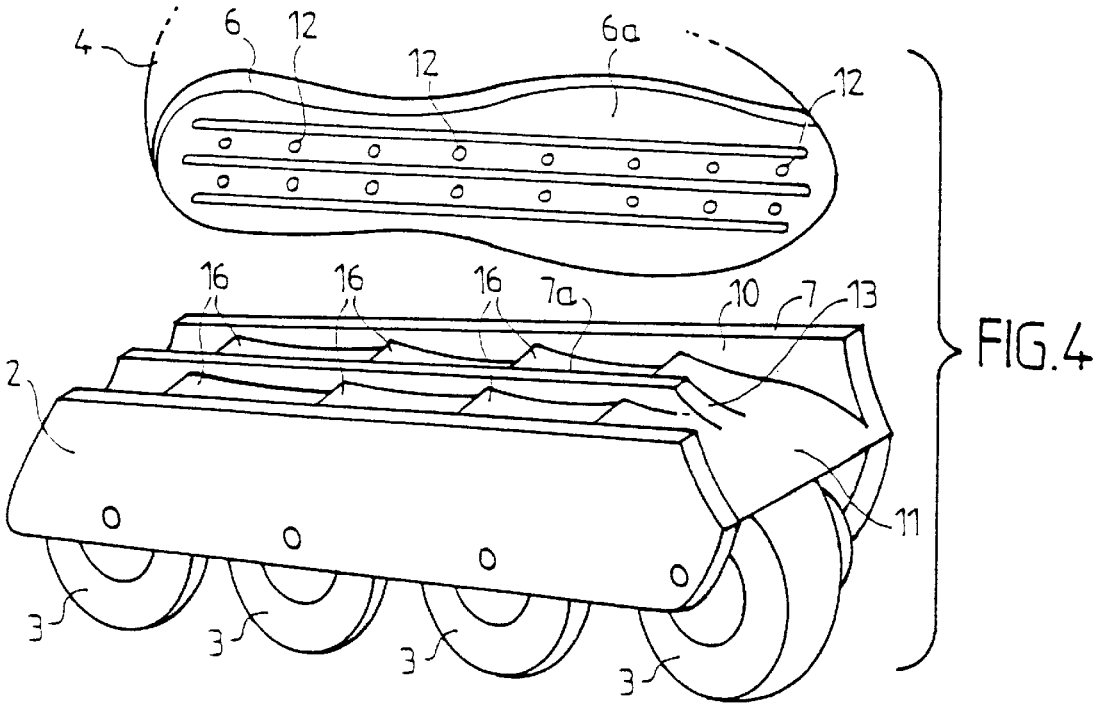
FIG. 4 is a perspective view of a skate according to FIG. 1 whose boot is detached from the chassis to show the ventilation arrangement of the boot.

The in-line roller skate generally designated by reference numeral 1 and shown in FIG. 1 includes a chassis 2 of which one longitudinal lower portion carries the wheels 3, on the one hand, and a boot 4 formed by an upper in the form of a rigid shell 5 overlaying a sole 6 adapted to be fixed on an upper plate 7 of the chassis 2, on the other hand, the internal volume of the shell 5 being in communication with the outside, so as to obtain the internal ventilation of the volume by means of the air supply A, via an air passage arrangement, or air passages, 8.

Generally, the passages for air A, interposed between an external collection zone and the internal volume of the shell 5, are constituted by a ventilation chamber 8 provided beneath the external sole 6 defining a plantar support 9 of the boot 4, and in communication with the internal volume of the shell 5.

According to the example shown in FIGS. 1–4, the ventilation chamber 8 is demarcated by the lower external plane or surface 6*a* of the sole 6 of the boot 4 and by the upper plane or surface 7*a* of the plate 7 of the chassis 2, which cooperates during closure with the plane 6*a* via a peripheral connecting portion 10 in which at least one zone 11 for collecting air A is provided. This ventilation chamber 8, provided between two rigid portions 6, 7 therefore has a non-deformable volume.

The collecting zone 11 here is a front inlet formed by an interruption of the peripheral edge 10 between the front of the plate 7 of the chassis 2 and the sole 6 of the tip of the boot 4. Of course, this air inlet could be lateral, or could even be combined with a plurality of front and/or lateral inlets. The advantage is that this air inlet is positioned on a surface of the skate arranged perpendicularly to the direction of displacement, such that the draft generated by the displacement of the skate rushes directly into the ventilation chamber, the air inlet being located at an exterior of the boot in free-flow communication with the ventilation chamber.

As shown in FIG. 1, the air inlet opening 11 is configured for producing an increase in the velocity of air entering the inlet opening and being directed to the ventilation chamber 8. As an example, it is seen that the inlet opening is forwardly flared. A forwardmost cross-section of has a greater area than that of a rearward cross-section.

The communication of the ventilation chamber 8 with the internal volume of the shell 5 is done through holes 12 obtained according to an arrangement selected on the plantar support 9, and in this example, the external sole 6. As also shown in FIGS. 2 and 3, the ventilation chamber 8 can be divided by at least one longitudinal rib 13, so as to constitute two air passage nozzles 14, 15 for the collected air A, across from which a plurality of aeration holes 12 are provided.

It is also contemplated to provide a larger number of nozzles. A single nozzle is also contemplated.

According to another characteristic of the invention, shown in FIG. 1, the bottom 7*a* of each of the nozzles 14, 15 for passage of air A includes, opposite each of the aeration holes 12, deflectors 16 adapted to create jumps and swirls of air A in order to increase its flow rate and to promote its forced introduction in the holes 12.

Furthermore, the internal plane 6*b* of the sole forming the plantar support 9 includes a plurality of longitudinal ribs 17 interrupted by connecting passages 18 therebetween so as to constitute baffle passages, thereby promoting the circulation and distribution of air A beneath the user's foot.

This first example of embodiment of the invention, with collection of air at the front, has the advantage of providing a much better imperviousness with respect to a construction with holes provided directly beneath the sole or directly on the shell. Moreover, the introduction of air is much better since the air inlet extends directly perpendicularly to the flow of the moving draft.

It must be specified that the rear end of the ventilation chamber 8 can include a plug 19 or a closure valve with adjustable output, for adjusting the air flow rate. Such a valve can also be provided at the front, at the level of the air inlet.

Alternative embodiments based on the principle that has just been described are shown in FIGS. 5–9. It is readily apparent that the alternate embodiments can embody the attributes of the embodiment of FIGS. 1–4, just described, that are not inconsistent with the principle that has just been described in connection with FIGS. 1–4. The principle includes, for example, the provision of the aforementioned deflectors 16, the baffle passages 18, and the plug or closure valve 19 for modifying the air flow rate of the ventilating air that exits the boot.

Figure 5:
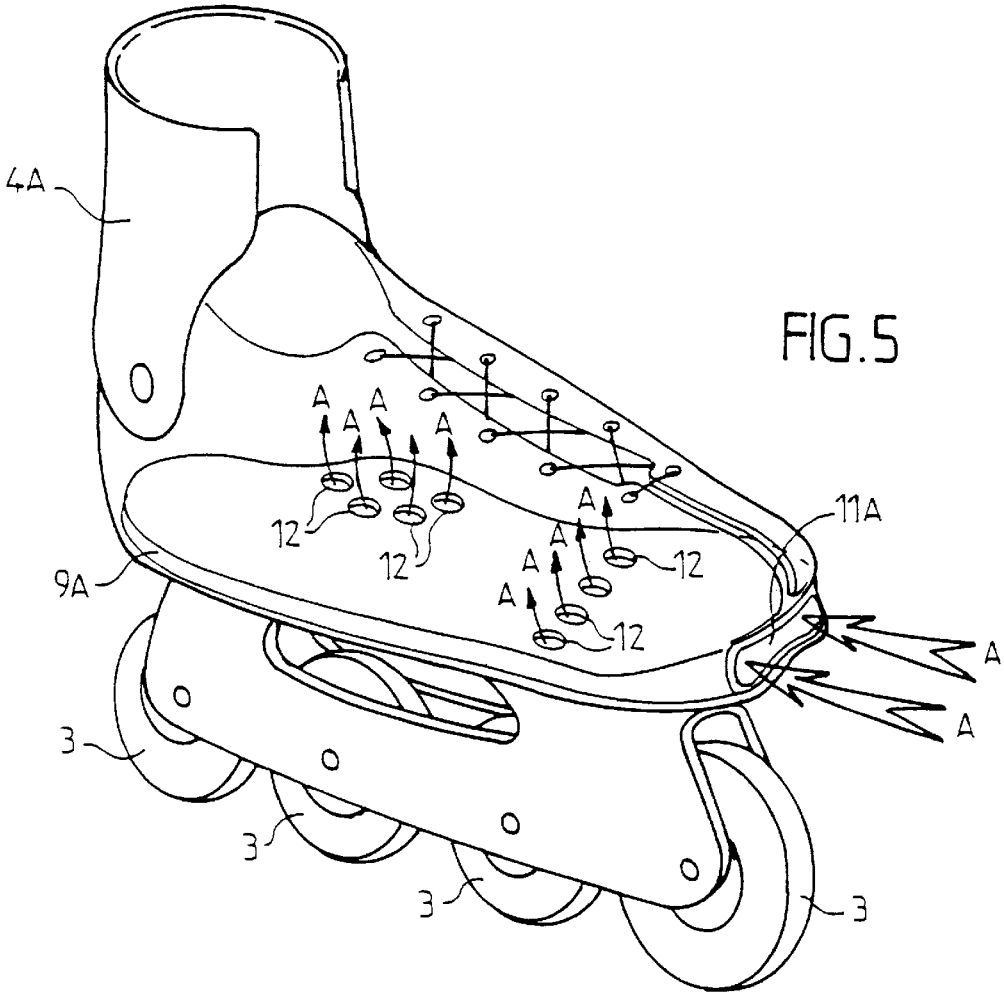
FIG. 5 is a perspective of a skate according to an alternative embodiment of the ventilation arrangement.
Figure 6:
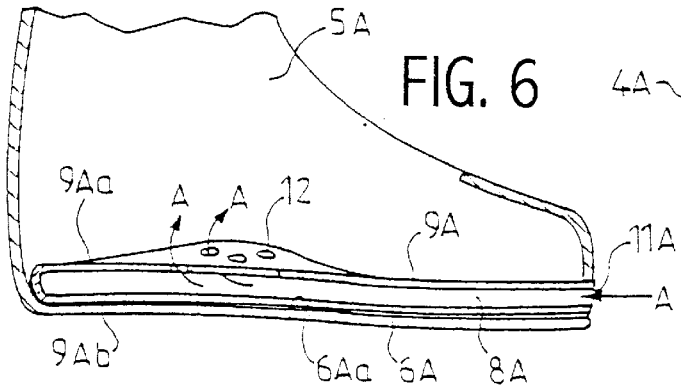
FIG. 6 is a longitudinal cross sectional view of a skate according to FIG. 5.
Figure 6A:
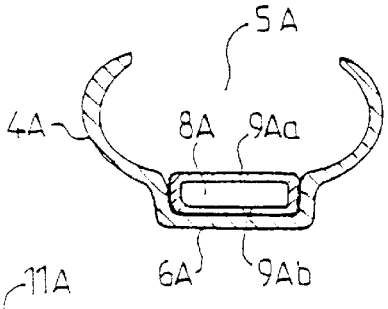
FIG. 6*a* if a transverse cross sectional view of the skate according to FIG. 6.

Thus, according to FIGS. 5, 6 and 6*a*, the ventilation chamber 8A is provided within the internal sole of the boot defining a plantar support 9A with double wall 9A*a* and 9A*b* forming a recessed volume of predetermined thickness and attached within the shell 5A on the upper internal plane 6A*a* of the external sole 6A.

Such a design not only makes it possible to render the plantar support removable to be washed for example, it can constitute, as a function of the selected material with which it is composed, an element for absorbing the weight of the skater.

Such a plantar support 9A can be made by blow molding a plastic material, independently of the remainder of boot, and therefore removable as previously mentioned.

In this case, the inlet 11A for air A is made during the extrusion operation on the plantar support itself, and communicates with the outside via an associated opening of the upper.

Figure 7:
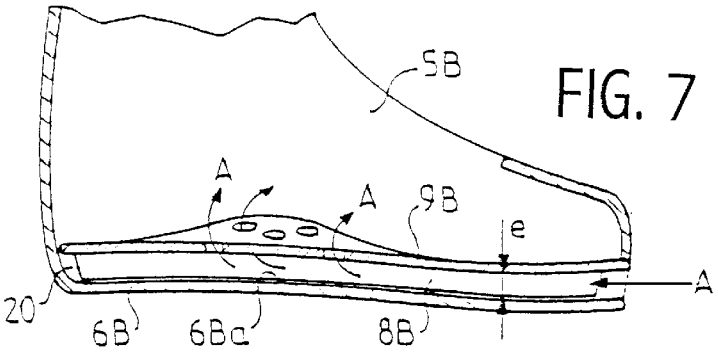
FIG. 7 is a longitudinal cross sectional view of a skate according to an alternative embodiment of the ventilation arrangement.

The example of embodiment of FIG. 7 essentially differs from the previous ones in that the ventilation chamber 8B is demarcated between a plantar support 9B attached within the shell 5B and the upper internal plane 6B*a* of the sole 6B with which it cooperates by obtaining a predetermined spacing "e" by means of longitudinal vertical ribs 20 extending from the plantar support 9B. The spacing "e" could also be obtained via a peripheral zone adjacent the plantar support 9B (not shown on the drawing).

In this case, the spacing "e" between the plantar support 9B and the internal plane 6B*a* of the sole 6B forming the ventilation chamber 8B is provided by the internal peripheral edge 20 of the plantar support.

Figure 8:
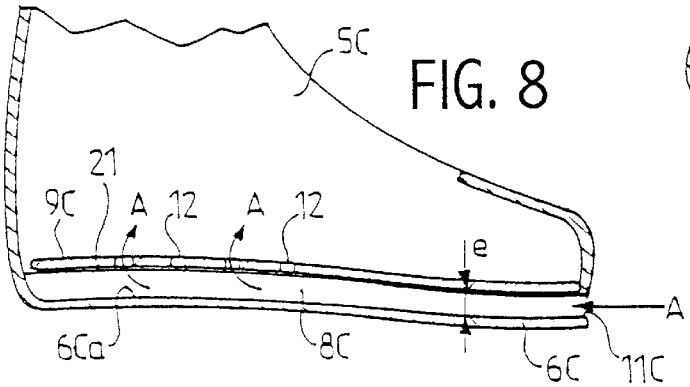
FIG. 8 is a longitudinal cross-sectional view of a skate according to an alternative embodiment of the ventilation arrangement.
Figure 8A:
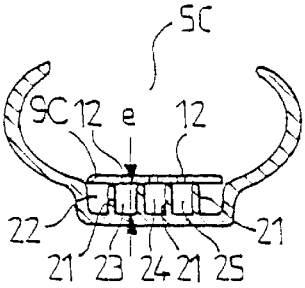
FIG. 8*a* is a transverse cross-sectional view of a skate according to FIG. 8.

In the example of FIGS. 8 and 8*a*, the difference resides in the fact that the spacing "e" between the plantar support 9*c* and the internal plane 6C*a* of the sole 6C of the boot forming the ventilation chamber 8C is provided by vertical longitudinal ribs 21 extending from the internal plane 6C*a* of the sole 6C, on top of which the plantar support 9C rests and whose lateral walls form nozzles 22, 23, 24, 25, . . . , for passage of air A, across from which a plurality of aeration holes 12 are provided.

An inlet 11C for air A is also provided at the front end of the shell, above the sole 6C.

Figure 9:
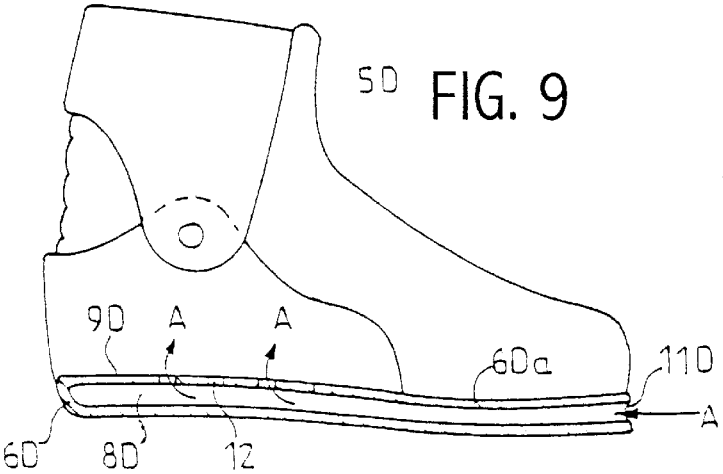
FIG. 9 is a longitudinal cross-sectional view of a skate according to an alternative embodiment of the ventilation arrangement.
Figure 9A:
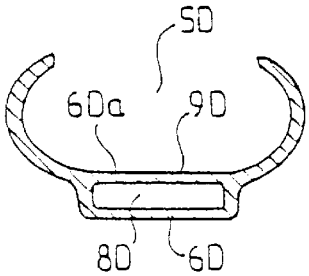
FIG. 9*a* is a transverse cross-sectional view of a skate according to FIG. 9.

Finally, according to the embodiment of FIGS. 9 and 9*a*, the ventilation chamber 8D is constituted by a recessed sole 6D defining a double bottom obtained during molding of the sole, and whose upper plane constitutes the plantar support 9D.

Likewise, an inlet 11D for passage of air A is provided at the front, on the sole 6D.

Such an embodiment is particularly adapted to a construction of a flexible upper 5D assembled by gluing, in a known manner, to the sole 6D made independently by molding.

The plantar support demarcating the upper plane of the ventilation chambers can be designed in any other ways, such as by assembly of a plurality of elements, for example.

The instant application is based upon French Patent Application No. 95.15016, filed on Dec. 8, 1995, the disclosure of which is hereby expressly incorporated by reference thereto, and the priority of which is hereby claimed under 35 U.S.C. §119.

What is claimed is:

1. An in-line roller skate comprising:

a chassis comprising an upper portion and a lower portion;

a plurality of wheels attached longitudinally to the lower portion of the chassis;

a boot having an upper, a sole, and a plantar support for supporting a foot, the boot being secured to the upper portion of the chassis, the boot having an internal volume;

a longitudinally extending rigid ventilation chamber defining a non-deformable volume extending substantially along an entire longitudinal length of the sole and comprising at least one inlet opening for allowing air to flow into and through the ventilation chamber during forward movement of the skate; and a plurality of holes selectively arranged through the plantar support to connect the ventilation chamber to the internal volume of the boot, said holes comprising outlet openings for the ventilation chamber.

2. An in-line roller skate according to claim 1, wherein:

said upper portion of said chassis comprises an upper plate.

3. An in-line roller skate according to claim 1, wherein:

the ventilation chamber is positioned beneath the plantar support of the boot and communicates with the internal volume of the upper through at least the plurality of holes.

4. An in-line roller skate according to claim 1, wherein:

the plantar support includes an internal surface;

baffle passages are provided above the internal surface of the plantar support, promoting circulation and distribution of air beneath the foot of the wearer of the boot.

5. An in-line skate according to claim 3, wherein:

the ventilation chamber is constituted by a recessed sole having a double bottom and an upper surface, the upper surface constituting the plantar support.

6. An in-line roller skate according to claim 1, wherein:

the upper portion of the chassis includes an upper surface; and the ventilation chamber is demarcated by a lower external surface of the sole of the boot, by the upper surface of the upper portion of the chassis, and by a peripheral connecting portion extending between the lower external surface of the sole of the boot and the upper surface of the upper portion of the chassis, said ventilation chamber including at least one air collecting zone.

7. An in-line roller skate according to claim 1, wherein:

at least one longitudinally extending rib defines two longitudinally extending air passage nozzles through which collected air is adapted to pass; and the plurality of holes are in communication with said air passage nozzles.

8. An in-line roller skate according to claim 1, wherein:

deflectors are arranged on a bottom of the ventilation chamber adapted to create jumps of air to promote a forced introduction of air into the holes.

9. An in-line roller skate according to claim 1, wherein:

the upper of the boot includes a shell;

the sole of the boot includes an upper internal surface;

a plantar support is positioned within the shell of the boot upper; and the ventilation chamber is demarcated between the plantar support and the upper internal surface of the sole of the boot, the plantar support and the sole of the boot are in cooperation upon assembly of the boot and are separated by a predetermined spacing.

10. An in-line roller skate according to claim 9, wherein:

the spacing between the plantar support and the internal surface of the sole is provided by an internal peripheral connecting portion.

11. An in-line roller skate according to claim 9, wherein:

the spacing between the plantar support and the internal surface of the sole is provided by internal ribs.

12. An in-line roller skate according to claim 9, wherein:

the spacing between the plantar support and the internal surface of the sole is provided by ribs and by an internal peripheral connecting portion.

13. An in-line roller skate according to claim 9, wherein:

the spacing between the plantar support and the internal surface of the sole is provided by vertical ribs extending from the internal surface of the sole;

the plantar support rests upon the vertical ribs; and the vertical ribs have walls forming air passage nozzles, the plurality of holes being provided across from the air passage nozzles.

14. An in-line roller skate according to claim 9, wherein:

the plantar support is a piece of material non-unitary with the sole and removable from the boot.

15. An in-line roller skate according to claim 1, wherein:

the ventilation chamber is constituted by a plantar support with a double wall forming a recessed volume of predetermined thickness attached within the upper on an upper internal surface of the sole.

16. An in-line roller skate according to claim 15, wherein:

the plantar support is made of a plastic material, by having been blow molded.

17. An in-line roller skate according to claim 1, wherein:

the opening for collecting air comprises an inlet provided at least one of forwardly of the ventilation chamber and laterally of the ventilation chamber.

18. An in-line roller skate according to claim 1, wherein:

said non-deformable volume of said longitudinally extending rigid ventilation chamber is demarcated by the sole of the boot and by the upper portion of the chassis.

19. An in-line roller skate comprising:

a chassis comprising an upper portion and a lower portion;

a plurality of wheels attached longitudinally to the lower portion of the chassis;

a boot having an upper, a sole, and a plantar support for supporting a foot, the boot being secured to the upper portion of the chassis, the boot having an internal volume;

a ventilation chamber positioned beneath the plantar support and defining a non-deformable volume comprising at least an opening for collecting air;

a plurality of holes selectively arranged through the plantar support to connect the ventilation chamber to the internal volume of the boot; and deflectors arranged on a bottom of the ventilation chamber adapted to create jumps of air to promote a forced introduction of air into the holes.

20. A roller skate comprising:

a chassis comprising an upper portion and a lower portion;

a plurality of wheels attached longitudinally to the lower portion of the chassis;

a boot having an upper, a sole, and a plantar support for supporting a foot, the boot having a certain length and being secured to the upper portion of the chassis, the boot having an internal volume;

a ventilation chamber defined by portions of the boot and chassis having a rigidity sufficient to maintain a certain volume under effects of weight and forces exerted on the boot and chassis during use of the skate, the ventilation chamber extending at least longitudinally along substantially the entirety of the length of the sole, said ventilation chamber being positioned at a determinate height above the ground;

an air inlet positioned at least at a front external surface of the boot in an area at a height substantially corresponding to said height of the ventilation chamber, the air inlet being configured for directing air into the ventilation chamber while the skate is moving in a forwardly direction; and a plurality of holes selectively arranged through the plantar support of the boot connecting the ventilation chamber to the internal volume of the boot.

21. A roller skate according to claim 20, wherein:

the air inlet is in open communication with the ventilation chamber.

22. A roller skate according to claim 20, wherein:

said height of the ventilation chamber is at a height substantially of an uppermost part of the chassis.

23. An in-line roller skate comprising:

a chassis;

a plurality of wheels attached longitudinally to the chassis;

a boot having a sole secured to the chassis and an upper extending upwardly from the sole, the upper defining an internal volume to receive the foot of a wearer, the internal volume being demarcated in part by a foot-supporting surface, a ventilation chamber forming a volume of predetermined height, the ventilation chamber being demarcated by at least two vertically spaced surfaces beneath the foot-supporting surface, the ventilation chamber being at least partially longitudinally divided so as to promote longitudinal air flow circulation within said chamber, at least a portion of the ventilation chamber having a non-deformable volume, and a plurality of holes arranged through the foot supporting surface for connecting the ventilation chamber to the internal volume of the upper;

at least one air inlet at an exterior portion of the skate in free-flow communication with the ventilation chamber for collecting air from outside to the ventilation chamber.

24. An in-line roller skate according to claim 23, wherein the ventilation chamber is demarcated between at least two vertically spaced portions of the sole, said two spaced portions comprising a lower bottom portion of the sole and an upper plantar support portion for supporting the foot, and the sole comprising said at least one air inlet for collecting air from outside to the ventilation chamber.

25. An in-line roller skate according to claim 24, wherein the bottom portion of the sole comprises longitudinally extending ribs, said plantar support being supported on said ribs.

26. An in-line roller skate according to claim 24, wherein the plantar support portion is removably positioned on the remainder of the sole.

27. An in-line roller skate according to claim 24, wherein the planar support portion includes a plurality of aeration holes selectively arranged through the plantar support portion, said plurality of aeration holes being in communication with said ventilation chamber.

28. An in-line roller skate according to claim 24, wherein said at least one air inlet for collecting air is provided at the front of the sole.

29. An in-line roller skate according to claim 28, wherein said skate extends in a longitudinal direction, and wherein said opening provided at the front of the sole is arranged perpendicularly to the longitudinal direction of the skate.

30. An in-line roller skate comprising:

a chassis and a plurality of longitudinally aligned wheels affixed to the chassis, a boot affixed to the chassis, said boot comprising an upper, said upper defining an internal volume within which a foot is to be positioned, and an internal support over which the foot is to be positioned, at least one longitudinally extending air ventilating passage arrangement defining a relatively rigid non-deformable volume, said air ventilating passage arrangement extending substantially the entire length of the boot, at least one air inlet in communication with said ventilating passage arrangement for receiving air, externally of said boot, into said ventilating passage arrangement, and a plurality of holes arranged through said internal support of said boot to connect said ventilating passage arrangement to the internal volume of said upper of said boot, said air inlet having a cross-sectional area at a forwardmost end greater than a cross-sectional area rearward of said forwardmost end.

31. An in-line roller skate according to claim 30, further comprising:

a ventilating passage output at a rear end of said at least one ventilating passage arrangement.

32. An in-line roller skate according to claim 30, wherein:

said at least one air inlet is positioned at an exterior portion of said boot in free-flow communication with said ventilating passage arrangement for collecting air from outside to said ventilating passage arrangement.

33. An in-line roller skate comprising:

a chassis having an upper portion and a lower portion;

a plurality of wheels attached longitudinally to the lower portion of the chassis;

a boot having an upper, a sole, and a plantar support for supporting a skater's foot within the boot, the boot being secured to the upper portion of the chassis, the boot having an internal volume;

a longitudinally extending rigid ventilation chamber formed between the sole and the plantar support and defining a non-deformable volume extending substantially along an entire length of the sole, the ventilation chamber having at least one inlet opening at a forward end for collecting air, the at least one inlet opening being configured for directing air into the ventilation chamber while the skate is moving in a forwardly direction, and a plurality of longitudinal ribs extending vertically between the sole and the plantar support to define a plurality of longitudinal passages for the flow of air therebetween;

a plurality of holes selectively arranged through the plantar support to connect the ventilation chamber to the internal volume of the boot, said holes comprising an outlet opening for the ventilation chamber.

* * * * *